US005203400A

United States Patent [19]

Tsunekawa et al.

[11] Patent Number: 5,203,400

[45] Date of Patent: Apr. 20, 1993

[54] AIR CONDITIONER

[75] Inventors: Shoji Tsunekawa, Gunma; Koji Mori, Ashikaga; Fujio Suzuki, Ohta; Yoshiki Ikari, Ashikaga, all of Japan

[73] Assignee: Sanyo Electric Co., Ltd., Osaka, Japan

[21] Appl. No.: 634,760

[22] Filed: Dec. 27, 1990

[30] Foreign Application Priority Data

Dec. 29, 1989 [JP] Japan ..... 1-340074

[51] Int. Cl.[5] ..... F24F 7/00

[52] U.S. Cl. ..... 165/59; 165/122; 62/262; 454/201

[58] Field of Search ..... 165/59, 61, 65, 122; 62/262; 98/94.2

[56] References Cited

U.S. PATENT DOCUMENTS 3,680,328 8/1972 McCarty ..... 62/262
4,100,764 7/1978 Murano ..... 62/289
4,102,148 7/1978 Matthews et al. ..... 62/77
4,492,094 1/1985 Katayama ..... 62/262
4,669,534 6/1987 Maeda et al. ..... 165/59

FOREIGN PATENT DOCUMENTS 60-66036 4/1985 Japan ..... 165/122
63-22433 6/1988 Japan .

*Primary Examiner*—Allen J. Flanigan
*Attorney, Agent, or Firm*—Darby & Darby

[57] ABSTRACT

In the present invention, for facilitating inspecting of a centrifugal type fan set in an air conditioner, a fan scroll is provided having a nose portion and a scroll portion of the fan scroll which are integrally molded, and the back of the fan scroll is mounted on a partitioning plate in the air conditioner. The scroll has a vent opening in its front portion and a discharge opening in its top portion, the two openings merging and being continuous and being large enough to permit removal of the fan therethrough.

2 Claims, 12 Drawing Sheets

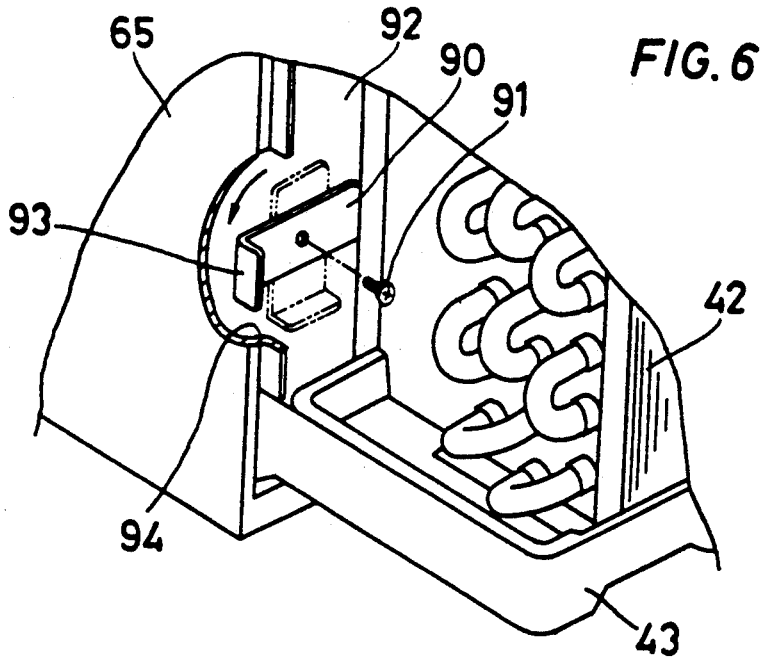
FIG. 6
FIG. 7
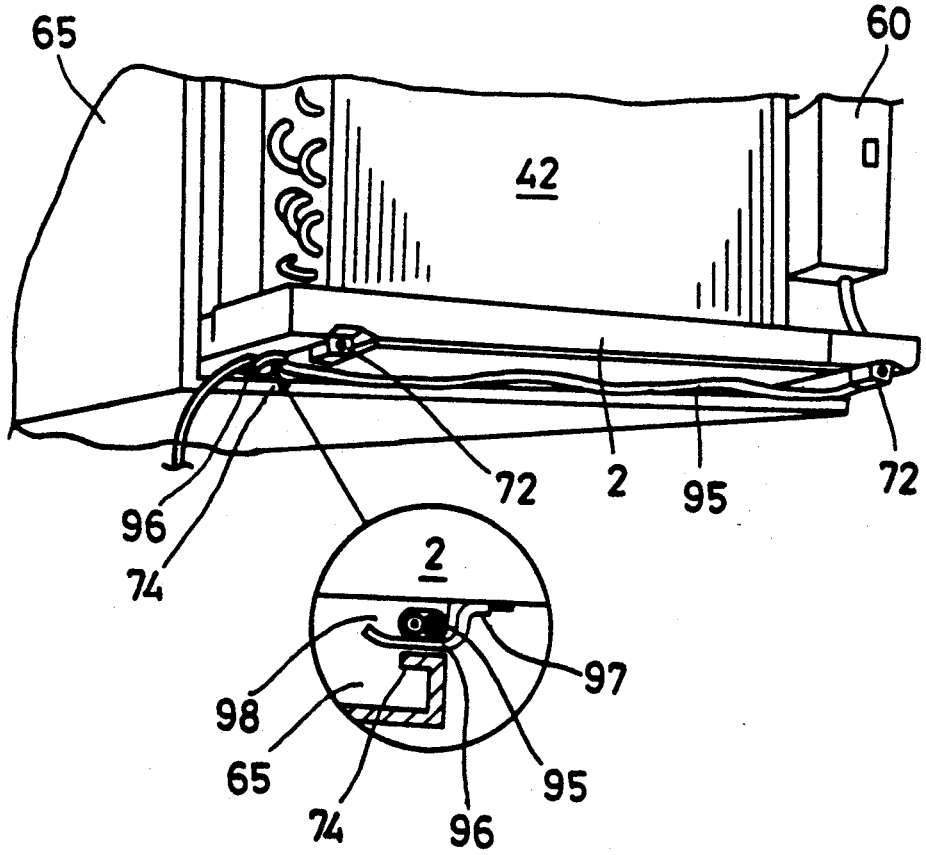

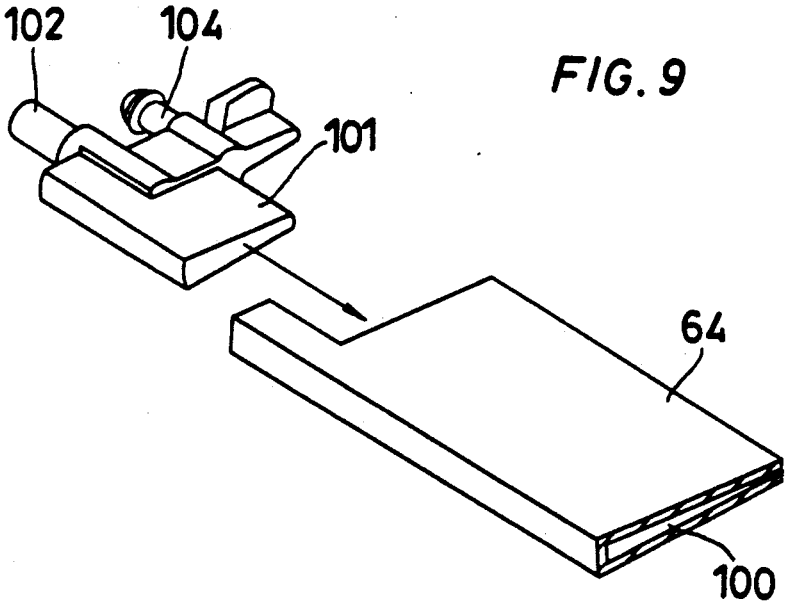
FIG. 9
FIG. 10
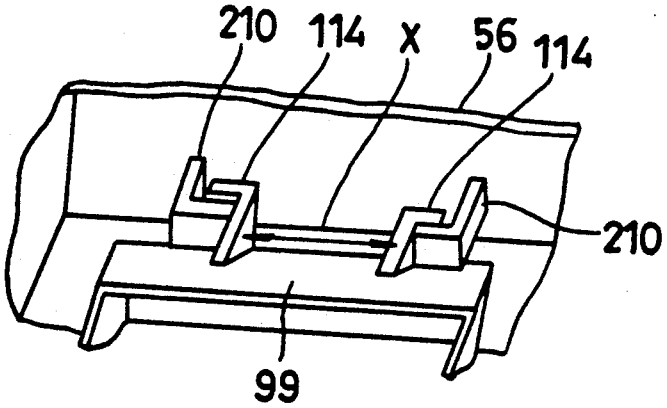

AIR CONDITIONER

BACKGROUND OF THE INVENTION

1. Field of the Invention

The present invention relates to an air conditioner, in which the interior of said air conditioner is divided by a partitioning plate into one chamber (indoor chamber) and another chamber (outdoor chamber).

2. Description of the Prior Art

An air conditioner provided with a centrifugal fan is shown in Japanese Utility Model Publication No. 63-22433. The centrifugal fan shown in the aforesaid publication is constructed as follows.

A rotational motor shaft of the centrifugal fan is mounted substantially horizontally and a fan casing consists of upper and low portions. An intake vent and a blow-off vent of said fan casing is provided at the front portion of said casing. A partitioning plate is also located at the front portion of said fan casing. A bell-mouth and a blow-off hole are provided in the partitioning plate, and by applying this partitioning plate at the front portion of said fan casing the bell-mouth is connected to the intake vent of said casing and the blow-off hole is connected to a discharge vent of said casing. A heat exchanger is set in front of the intake vent, and air heated or cooled by the heat exchanger is discharged out of the blow-off hole of the blower.

In the air conditioner as described above, when the centrifugal fan is inspected, the partitioning plate and the upper casing (upper portion) have to be removed, which work is cumbersome. Furthermore, the fan casing consists of upper and lower portions, and when the centrifugal fan is inspected, the upper casing (upper portion), is removed from the lower casing (lower portion) as mentioned above. Therefore, the seal between these sections is possibly degraded every time work is done.

SUMMARY OF THE INVENTION

It is an object of the present invention to facilitate inspection of a centrifugal fan encased in an air conditioner.

For achieving the aforesaid object, in the present invention, the fan scroll has a scroll portion with an integral nose portion, the scroll portion defining a front part having a vent opening and an upper portion having a discharge opening, the two openings, merging to form a single opening in the front and upper portions of the scroll, and the back of the fan scroll is mounted on a partitioning plate. A mounting plate having an intake hole is detachably mounted on the front surface of the fan scroll, and a heat exchanger is mounted in front of the fan scroll leaving a dimension larger than the thickness of the centrifugal fan. Sufficient clearance is provided between the heat exchanger and the fan to permit it to be removed from its shaft without removing the heat exchanger. A plate is mounted over the upper member of the heat exchanger and the upper portion of the mounting plate, said plate covering clearance between the heat exchange and the mounting plate.

When the centrifugal fan is inspected, the plate is first removed to obtain access to the space between the heat exchanger and the mounting plate. Then the mounting plate is removed from the front portion of the fan scroll. Next, the centrifugal type fan is pulled forward off of the motor shaft supporting the fan, and the fan is removed through the upper opening of a fan scroll.

Thereby, the inspection of the centrifugal fan can be made without removing the heat exchanger and the fan scroll.

BRIEF DESCRIPTION OF THE DRAWINGS

FIG. 6 is a sectional perspective view of essential parts of the air conditioner showing the relationship between exterior trim parts and auxiliary fittings;

FIG. 7 is a low perspective view of the air conditioner showing the mounting state of a power supply cord of the air conditioner;

FIG. 9 is an enlarged view showing essential parts of FIG. 8;

FIG. 10 is a perspective view showing a part of the back of the front panel;

DETAILED DESCRIPTION OF THE INVENTION

Figure 1:
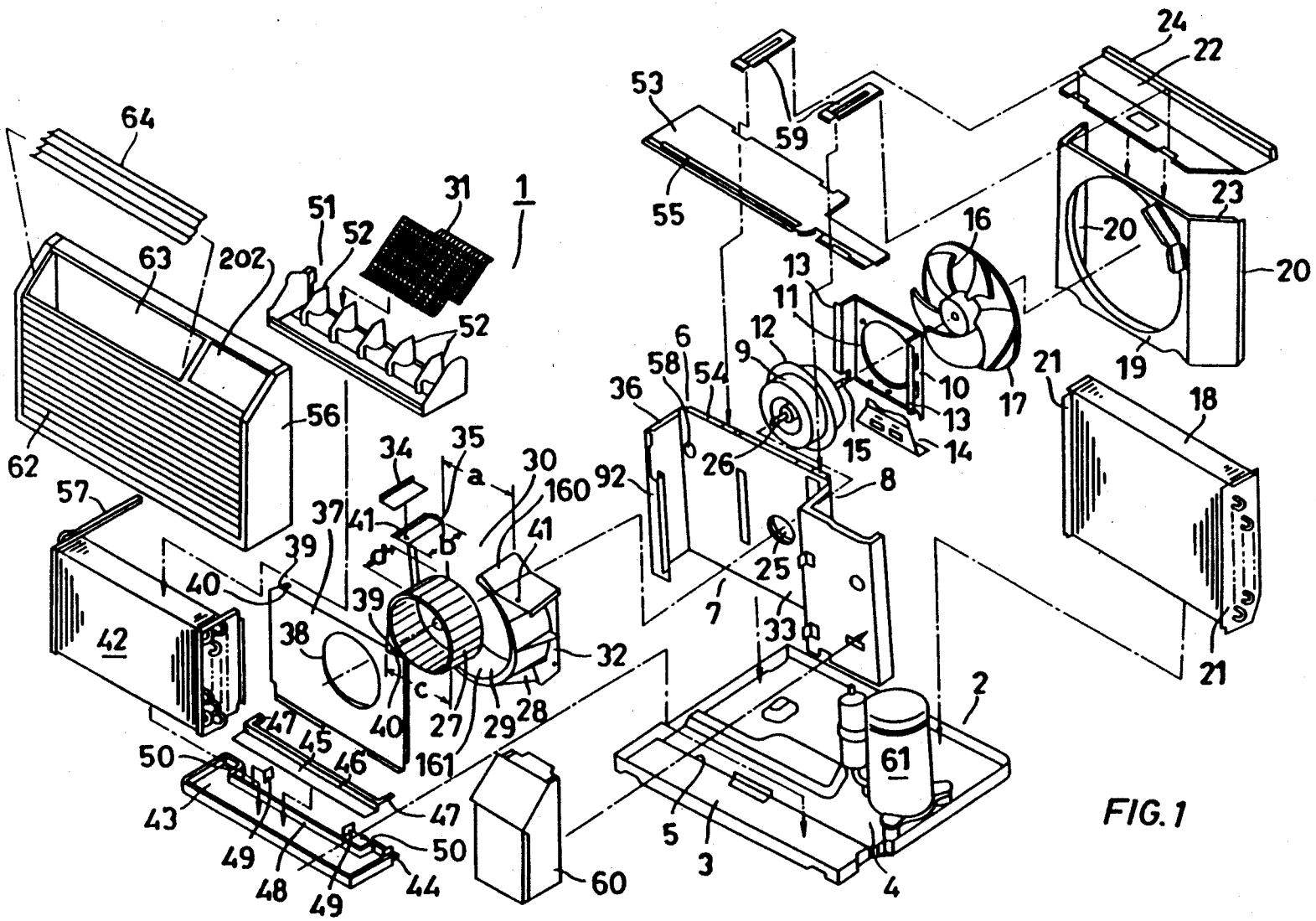
FIG. 1 is an exploded perspective view of an indoor type air conditioner showing an embodiment of the present invention.

In FIG. 1, reference numeral 1 designates a room type built-in air conditioner. The air conditioner comprises the body 1 and a case (described later) into which the body 1 is inserted. Reference numeral 2 designates a bottom plate, formed with a stepped portion 5 so that a front portion 3 thereof is higher by one step than a rear portion 4. Reference number 6 designates a partitioning plate mounted on the bottom plate, and the bottom plate 2 is divided by the partitioning plate 5 into an indoor (one) chamber 7 and an outdoor (another) chamber 8.

Reference numeral 9 designates a fan motor, and 10 designates a mounting plate for the fan motor. A flange 12 of the fan motor 9 is secured to one side 11 of the mounting plate 10. A leg 13 of the mounting plate 10 is mounted on the outdoor chamber 8 of the partitioning plate 6. Reference numeral 14 designates a reinforcing plate for the mounting plate 10, which will be described in detail later. Reference numeral 15 designates one drive shaft of the fan motor 9, to which a propeller fan 16 is secured. Reference numeral 17 designates a slinger ring. Drain water in the rear portion 4 of the bottom plate 2 is sprayed by the slinger ring 17 so as to be splashed to an outdoor heat exchanger 18.

Reference number 19 designates a fan cover for the propeller fan 16, and both left and right members 20 are secured to left and right tube plates 21, respectively, of the outdoor heat exchanger 18. Reference number 22 designates an outdoor side top plate, which is secured to an upper edge 23 of the fan cover 19 to cover the outdoor heat exchanger 18. Reference 24 designates a seal material, which is attached to the rear edge of the outdoor side top plate 22.

An opening 25 is provided in the partitioning plate 6, through which extends the other drive shaft 26 of the fan motor 9. Reference number 27 designates a centrifugal fan mounted on the drive shaft 26. Reference numeral 28 designates a fan scroll of the fan and has at its front portion with a vent opening 29 and at its upper portion with a discharge opening 30. That is, the fan scroll 28 has a nose portion 160 and a scroll portion 161 that are integrally formed. A vent opening is formed in the scroll front portion and a discharge opening in the scroll upper portion, the two openings merging to form a single continuous opening.

Reference number 31 designates a wire net to cover the discharge opening 30. The fan scroll 28 has a flange 32 back portion mounted to the indoor side 33 of the partitioning plate 6 and secured to the partitioning plate 6 by means of a screw (now shown). The size of the discharge opening 30 of the fan scroll 28 (i.e., a width a and depth b of the discharging opening 30) is set to be larger than that of the centrifugal fan 27 (i.e., a diameter c and a thickness d of the centrifugal fan 27) so that the centrifugal fan 27 may be removed from the discharge opening 30.

Reference numeral 34 designates a pipe cover, one end of which is secured to an end 35 on the opposite nozzle side of the fan scroll 28 while the other end thereof is secured to a left edge 36 of the partitioning plate 6.

Reference number 37 designates a plate mounted on the front portion of the fan scroll 28, said mounting plate being formed with an intake hole 38. Reference number 39 designates a mounting member obtained by rearwardly bending a part of an upper edge of the mounting plate 37, said mounting member 39 having a mounting hole 40. When the mounting plate 37 is moved down along the front surface of the fan scroll 28, the mounting hole 40 of the mounting member 39 is inserted into a pin 41 on the upper surface of the fan scroll 28. Thereby, the mounting plate 37 is secured to the front surface of the fan scroll 28, and an intake hole 38 is aligned with to the opening of the centrifugal fan 27. Reference numeral 42 designates a heat exchanger which is mounted in front of the fan scroll 28 leaving a distance larger than a thickness d of the centrifugal fan. A distance projected toward the front side of motor shaft for rotatably supporting the centrifugal fan is set to be smaller than a distance between the rear surface of the heat exchanger and the front surface of the centrifugal fan. Accordingly, when the condition of the centrifugal fan 27 is to be inspected, the mounting plate 37 is drawn upwardly, and thereafter, a screw driver is inserted into a hole 150 of the plate of the centrifugal fan 27 to turn and loosen a screw 152 of a boss 151 to remove it from the drive shaft 26 of the fan motor 9. After the centrifugal fan 27 is moved slightly aside (a clearance 153 between the indoor heat exchanger 42 and the mounting plate 37), the centrifugal fan 27 is raised from the discharge opening 30 of the fan scroll 28. In this manner, inspecting of the centrifugal fan 27 is carried out simply (see FIG. 3).

Reference numeral 43 designates a drain pan made of foamed styrol placed in the front portion 3 of the bottom plate 2, and a drain opening 44 communicates with to the outdoor side 8 through a lower cut opening (not shown) of the partitioning plate 6. Reference numeral 45 designates a heat shield plate laid at the rear of the drain pan 43, and a riser member 46 and a rear member 47 of the heat shield plate 45 cover a rise edge 48 of the drain pan 43.

Reference numeral 49 designates a piece of aluminum tape, which is attached to a riser wall 50 of a corner portion of the drain pan 43. Accordingly, a part of the radiant heat from an electric heater (now shown in FIG. 1) mounted on the front surface of the mounting plate 37 is intercepted by the heat shield plate 45 and the aluminum tape 49 to reduce the heat to be transmitted to the drain pan 43 made of foamed styrol to prevent the drain pan 43 from being thermally deformed. The indoor heat exchanger 42 is placed on the drain pan 43. A refrigerant pipe 57 connected to the indoor heat exchanger 42 extends around (leftward) the fan scroll 28 and is inserted into a pipe hole 58 of the partitioning plate 6. A pipe cover 34 is arranged above the refrigerant pipe 57. Reference number 51 designates a blow-off diffuser member arranged above the indoor heat exchanger 42, having longitudinal blades 52 arranged on a plate 154. This plate 154 covers a clearance 153 between the heat exchanger 42 and the mounting plate 37 and mounted thereover.

Reference numeral 53 designates an indoor side top plate secured to an upper edge 54 of the partitioning plate 6, and an engaging (fixing) member 55 is provided on the upper surface of said top plate (53). A front panel 56 is engaged with the engaging number 55. When the indoor heat exchanger 20 is to be checked, a part of the refrigerator pipe is cut within the outdoor chamber 8, and the refrigerant pipe 57 extended from the indoor heat exchanger 42 is straightened. Next, when the indoor top plate 53, the (blow-off) diffuse member 51 and the pipe cover 34 are removed, the refrigerant pipe 57 is positioned sideward of the fan scroll 28, extending through the pipe hole 58 of the partitioning plate 6. Accordingly, when the indoor heat exchanger 42 is drawn upward and thereafter the indoor heat exchanger 42 is drawn forward, the indoor heat exchanger 42 can be removed without removing the fan scroll 28.

Reference numeral 59 designates a flat-plate fitting which connects the upper edge 54 of the partitioning plate 6 with the outdoor top plate 22. Reference number 60 designates an electric parts box which is secured to the indoor side of the partitioning plate 6.

Reference number 61 designates a compressor which is mounted on the rear portion 4 of the bottom plate 2. The front panel 56 is provided at the lower portion with an intake grill 62 and at the upper portion with a discharge opening 63. Reference numeral 64 designates a movable blade (hereinafter referred to as "lateral blade") arranged on the discharge opening 63. Reference number 202 designates an operating opening provided sideward of the discharge opening 63.

Figure 2:
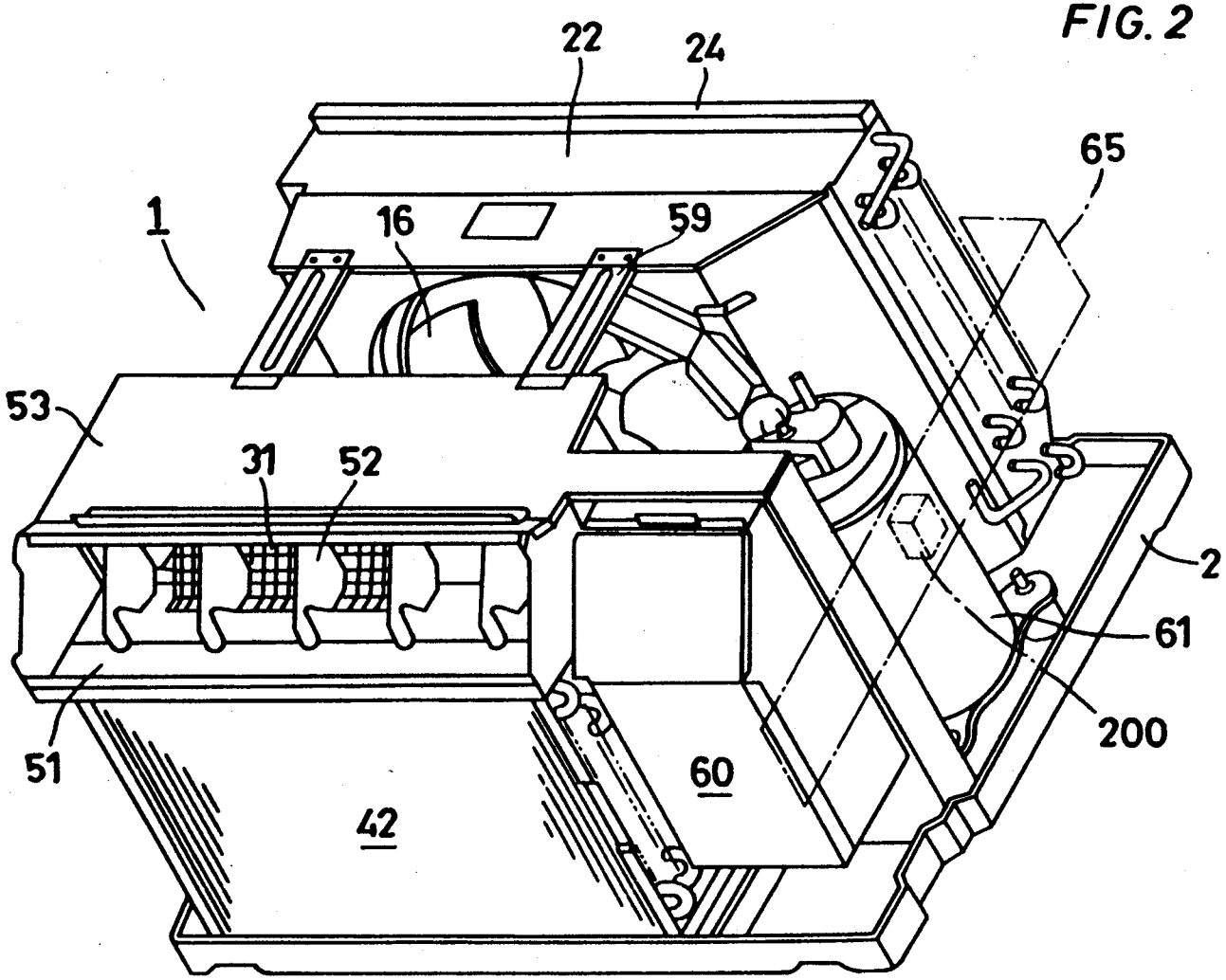
FIG. 2 is a perspective view showing the state where a front panel of the air conditioner is removed.

FIG. 2 is a perspective view showing the body 1 in the assembled state (except the front panel 56). In FIG. 2, reference number 65 designates a case for the body 1, and 200 denotes a pad made of polyethylene attached to the inside of the case 60, the pad 200 being positioned sideward of the compressor 61. Accordingly, even if the compressor 61 tends to vibrate abnormally as when the air conditioner has fallen or the like during transportation, this vibration is absorbed by the pad 200. It is to be noted that the body 1 can be shipped even when the case 65 is removed. In this situation, a temporary cover in place of case 65 is mounted on this unit. A pad made of foamed styrol is attached to the inside of the cover, and the abnormal vibration of the compressor 61 is absorbed by the pad. When the compressor is installed, the cover as well as the pad are removed.

Figure 3:
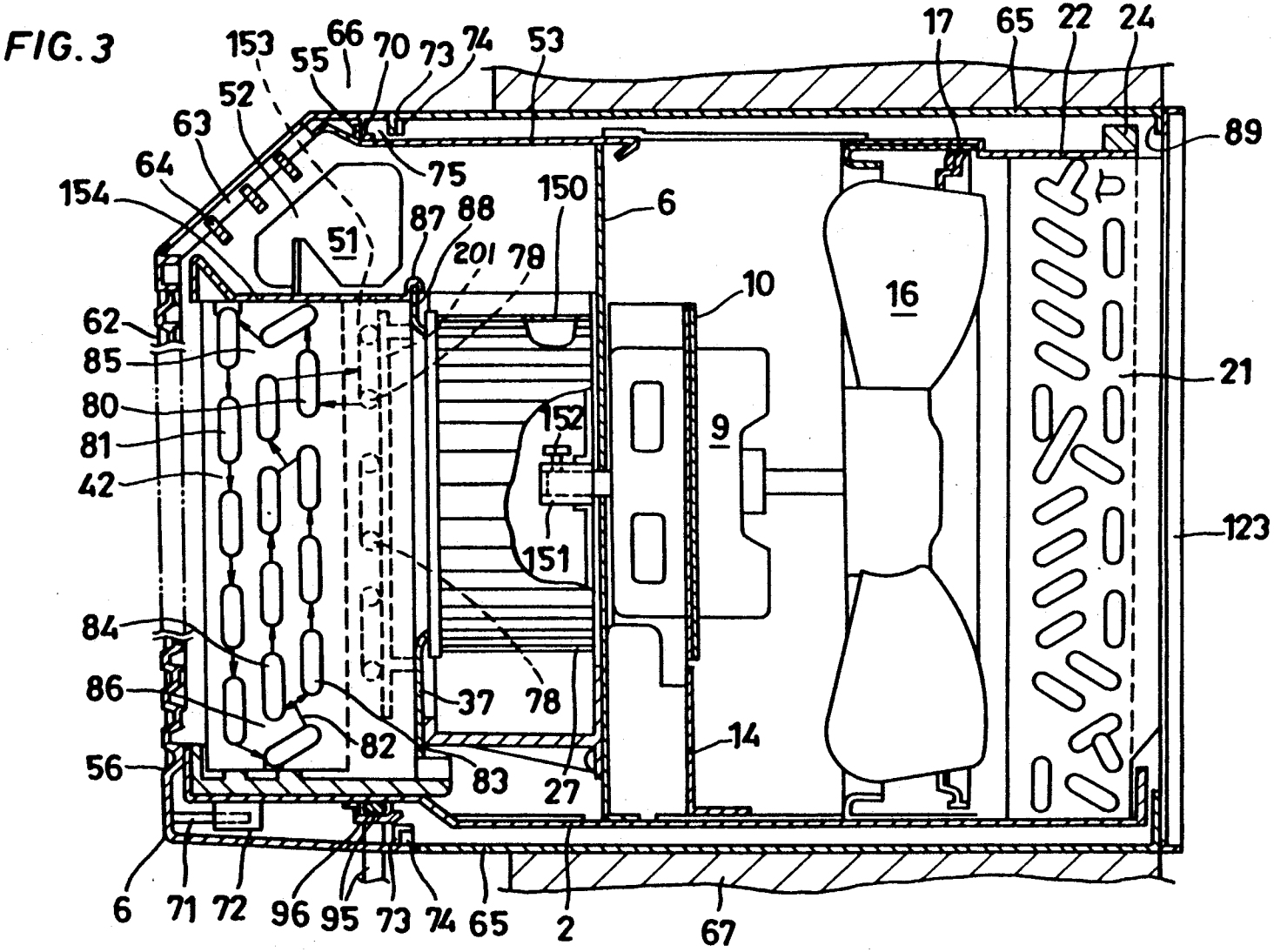
FIG. 3 is a longitudinal sectional view of the air conditioner.
Figure 4:
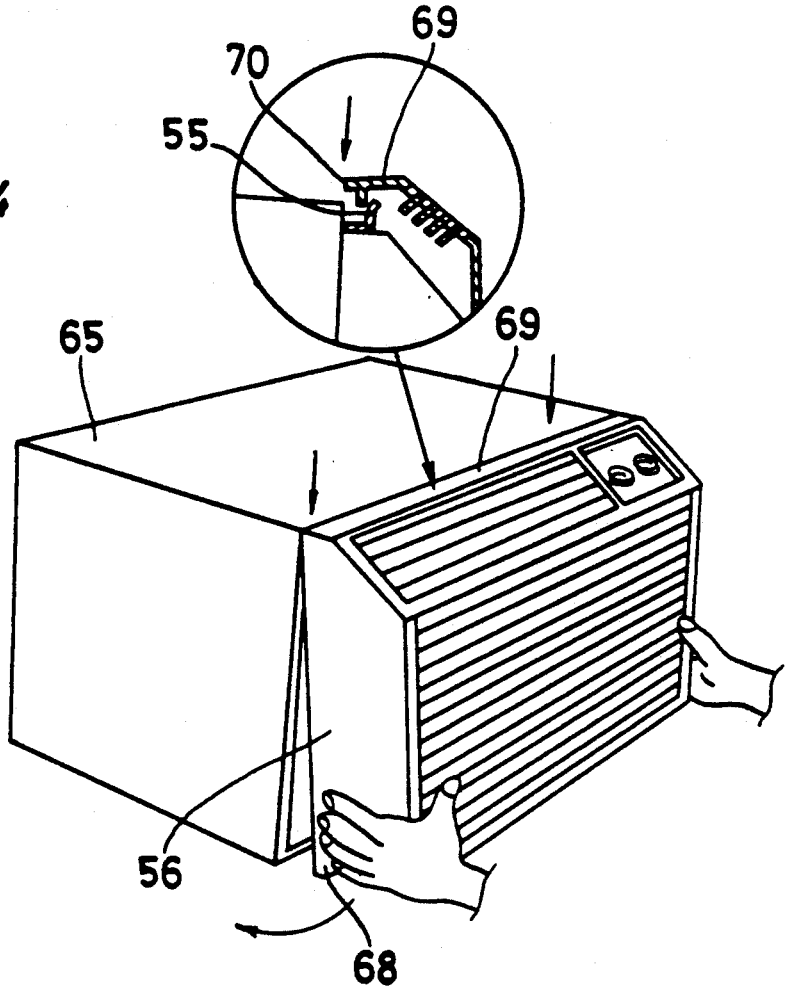
FIG. 4 is an explanatory perspective view showing the mounting arrangement of the front panel of the air conditioner.

FIG. 3 is a longitudinal sectional view of an air conditioner 66. The outer case 65 is mounted entends through the indoor wall 67. The body 1 as in FIG. 2 is inserted into the case 65 from the indoor side. Thereafter, the lower portion 68 of the front panel 56 is moved as shown in FIG. 4, the projecting member 70 of the upper portion 69 of the front panel 56 is brought into engagement with the engaging member 55, and the engaging member 71 of the lower portion 68 is inserted into and locked at a receiver 72 of the bottom plate 2. When the front panel 56 is mounted in a manner as described above, the rear edge 73 of the front panel 56 touches the front edge 74 of the case 65 so that the surface of case 65 is registered with the surface of the front panel 56.

Figure 5:
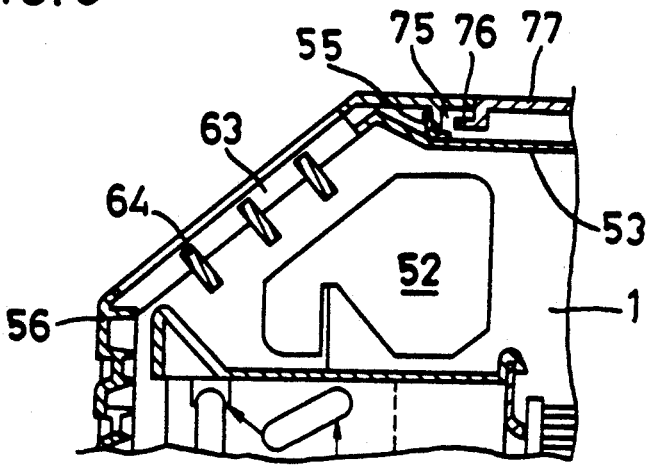
FIG. 5 is a longitudinal sectional view of essential parts showing a different mounting arrangement for the front panel.

The projecting member 70 of the front panel 56 is inward from the rear edge 73 of the front panel 56, and a space 75 is formed around the rear edge. Since the space is formed as described, when the body 1 is inserted into a further external trim body 77, the case 65 with a projection 76 provided on the front edge thereof and the front panel 56 are brought into engagement with the engaging member 55, the projection 76 is positioned in the space 75 of the front panel. The front panel 56 is at the same level as the external trim body 77. In other words, either the external trim body 77 having a projection on the front edge thereof (see FIG. 5) or case 65 having no projection 76 on the front edge thereof (see FIG. 3) may have the front panel 56.

Reference numerals 78 and 79 (see FIG. 15) designate a heater and a fuse thereof, respectively, which are secured to the mounting plate 37 through a support frame 201, details of which will be described later. The indoor heat exchanger 42 functions as an evaporator, and a refrigerant flows as indicated by arrows in FIG. 3. More specifically, a refrigerant at a low temperature reduced in pressure by a reducer (not shown) first flows into a pipe 80 downstream, ad thereafter flows in an inverted U-shape along the upper portion 85 within the heat exchanger into a pipe 81 upstream. The refrigerant flows within the pipe upstream from top to bottom, and is divided at the lower portion thereof into two flows by special bend 82 so that they flow into a pipe 83 downstream and an intermediate pipe 84. After they have been merged at the upper portion, they are returned to the compressor from the upper portion.

The low temperature refrigerant is first made to flow in an inverted U-shaped fashion at the upper portion 85 of the indoor heat exchanger 42 because the heat-exchanger rate at the upper portion 85 is made to increase more than that at the low portion 86. Thereby, air having passed through the upper portion 85 of the indoor heat exchanger 42 is cooled and lowered in temperature more than air 86 having passed through the lower portion. Accordingly, the air having such a low temperature flows into a protective device (fuse) 79 of the heater 87, whereby dew is kept from sticking to the protective device 79.

Accordingly, inferior insulation is avoided in the protective device 79, and when the heater is energized in a heating operation, it is possible to prevent the heater 78 from being abnormally heated.

The rear edge 87 of the blow-off member 51 is formed in an inverted U-shape so that the upper edge 88 of the mounting plate 37 is fitted into the rear edge 87 of the blow-off member 51. The upper edge 88 of the mounting plate 37 is locked by the blow-off member 51, and the mounting plate 37 and the blow-off member 51 are positively combined with each other so that air discharged from the discharge opening 30 of the fan scroll 28 does not leak in and between the mounting plate 37 and the blow-off member 51.

When the body 1 is put into case 65, the seal 24 attached to the outdoor side to plate 22 moves close to the rear edge 89 of case 65. The seal 24 is made close to the rear edge 89 of case 65 as described because air discharged from the outdoor heat exchanger 21 is greatly suppressed to enter a clearance between 65 and the outdoor side top plate 22.

FIG. 6 is a perspective view showing a portion in the vicinity of a left and lower portion of the indoor heat exchanger. Reference numeral 90 designates an auxiliary fitting having a substantially L-shape in section, which is rotatably fixed to a front member 92 of the partitioning plate by means of a screw 91. When the body 1 is removed from case 65 for the purpose of checking inspecting the auxiliary fitting 90 is directed downward (in the state indicated by the phantom outline). On the other hand, after the body 1 has been inserted into case 65, the auxiliary fitting 90 is made horizontal and the,. projecting member 93 is brought into engagement with the front edge 94 of case 65. With this, the body 1 is not carelessly drawn out of case 65. For example, when the body 1 is inserted into case 65 and thereafter the body 1 is pushed from the outdoors into the indoor, the body 1 with the front panel 56 mounted thereon falls into the indoors. Only case 65 remains, and the wall is in the extend-through state through a case 65, which is insecure in terms of prevention of crimes.

FIG. 7 is a perspective view showing the lower portion of the body 1. Reference number 95 designates a power source cord extended from an electric parts box 60 and 96 denotes a clamp for holding the cord 95, with its end 97 secured to the bottom plate 2. Accordingly, the power source cord 95 is pulled from the far side 98 toward the side 97 into engagement with the clamp 96. In the state where the body 1 is inserted into a case 65 (see FIG. 3), the front edge 74 of case 65 is positioned below the clamp 96. Accordingly, when the power source cord 95 is pulled from the far side 98 toward this side 97 of the clamp 96 into engagement with the clamp and the body 1 is inserted into case 65, even if the power source cord 95 is carelessly pulled toward the side (on the front panel 56 side) so that the clamp 96 tends to be deformed, the clamp 96 is prevented from being deformed by the presence of the front edge 74 of a case 65. Accordingly, the power source cord 95 cannot be slipped off from the clamp 96. Since the power source cord 95 is pulled out of the cut opening (now shown) at the lower portion of the front panel 56, even if the power source cord 95 is pulled from this side, the front panel 56 is not disengaged.

Figure 8:
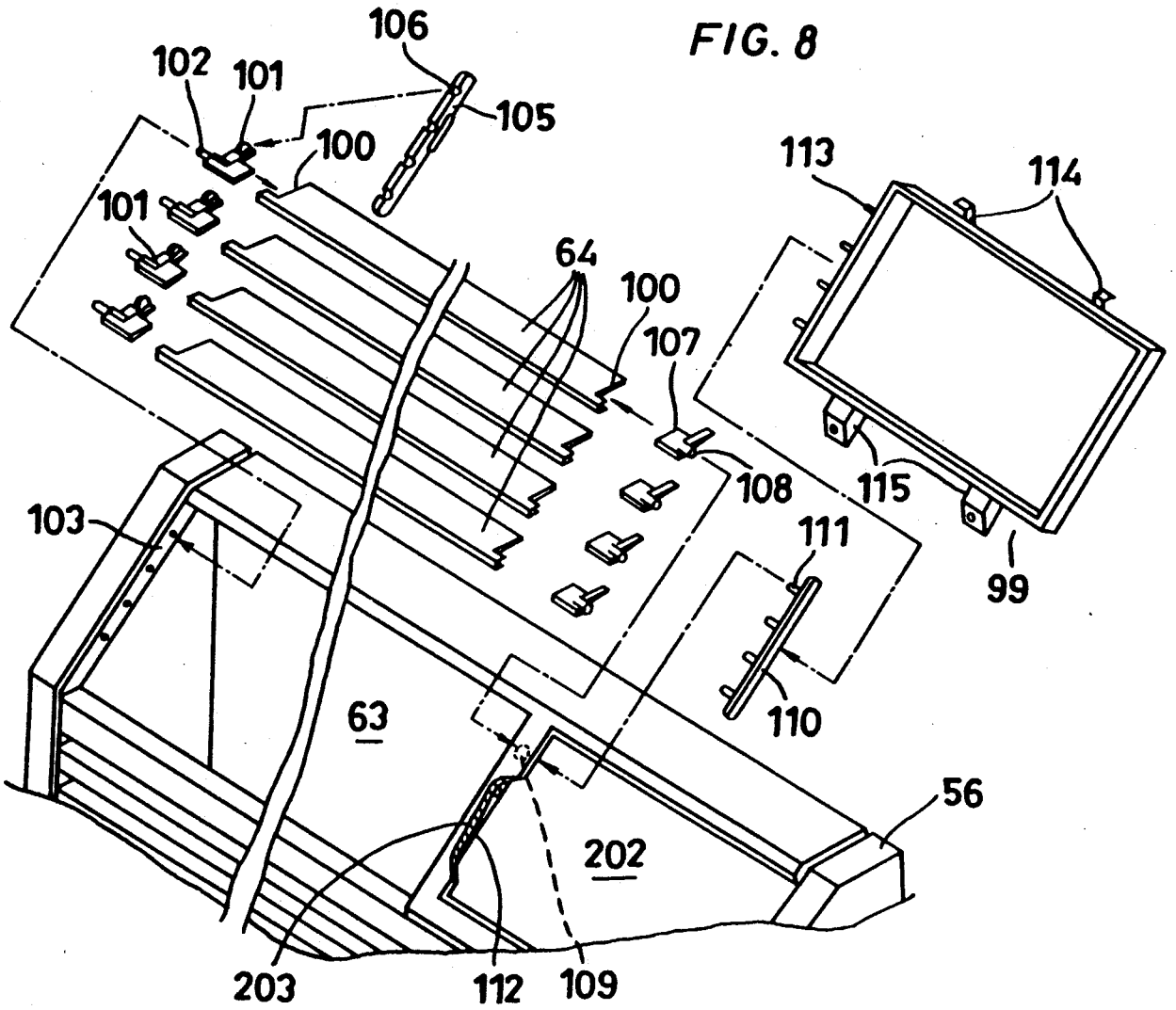
FIG. 8 is an exploded perspective view of a discharge vent of the air conditioner.

FIG. 8 is a perspective view showing the relationship between the lateral blades 64 arranged on the discharge opening 63 and a display frame 99 mounted on the operating opening 202. The lateral blade 64 is formed by bending a sheet the interior of which is provided with a space 100. Reference numeral 101 designates a left support fitting made of synthetic resin, which is inserted into the space 100 of the lateral blade 64 (see FIG. 9). Reference numeral 102 designates a left shaft (one shaft), which is inserted in to a left support hole 103 of the discharge opening 63. Reference numeral 104 designates an interlock shaft, into which is fitted a notch 106 of an interlock plate 105. Reference numeral 107 designates a right support fitting made of synthetic resin, which is inserted into the space 100 of the lateral blade 64. Reference numeral 108 designates a cylindrical right shaft (the other shaft). The outside diameter of the right shaft 108 is set to be smaller than the inside diameter of the right support hole 109 of the discharge opening 63. Reference numeral 110 designates a fitting, which is formed with a projecting pin 111. When the fitting 110 is urged against the left member 112 of an operating opening 202, the projecting pin 111 is inserted in its extreme end into the right shaft 108 of the right support fitting 107. Thereby the lateral blades 64 are supported rotatably within the blow-off opening 63.

As described above, the right shaft 108 of the right support fitting 107 is placed against the right side 203 of the blow-off opening 63 and supported by the projecting pin 111 of the fitting 110, and therefore, the left and right side walls of the discharge opening 63 are formed with support holes 103 and 109, respectively. Accordingly, the external appearance of the side wall of the blow-off opening 63 is improved, and a turbulent flow in the vicinity of the side wall is reduced. In the case where cool air is blown out of the blow-off opening 63, dew is prevented from sticking around the discharge opening 63.

Reference numeral 99 designates a display, frame fitted into the operating opening 202. The display frame has a side projection 113, at the upper portion has an engaging member 114 and at the lower portion has a fixed member 115, respectively. The fixed member 115 is secured by means of a screw to the underside of the back of the front panel 56 while fitting the engaging member 114 into a projection 210 (see FIG. 10) on the upper-back of the front panel 56. Here, a distance x between the engaging members 114 coincides with a distance between the projections 210. Accordingly, the display frame 99 is located at the operating opening 202 of the front panel 56 in the state where the engaging members 114 of the display frame 99 are fitting into the projections 210. By securing the fixed member 155 to the under-back of the front panel by means of a screw, the projection 113 engages the fitting 110 to prevent the latter from being disengaged.

Figure 11:
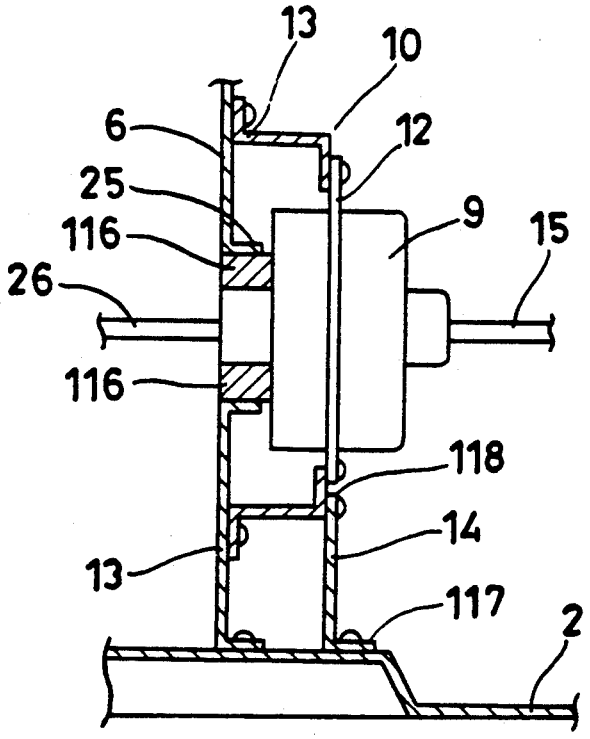
FIG. 11 is a sectional view of essential parts showing the mounting state of a fan motor of the air conditioner.

FIG. 11 is a sectional view showing the relationship between the partitioning plate 6, the fan motor 9, the fixing plate 10 for the fan motor, and the reinforcing plate 14. Reference numeral 116 designates a rubber cushion provided between the fan motor 9 and the opening 25 of the partitioning plate 6. The reinforcing plate 14 has a lower end 117 and an upper end 118 secured to the bottom plate and the fixing plate 10, respectively. Since the partitioning plate 6 with the fan motor 9 mounted thereon and the bottom plate 2 are connected by the reinforcing plate 14 as described above, the vibration during rotation of the fan motor 9 is received by the partitioning plate 6 and the bottom plate 2 so that the vibration of the fan motor 9 is not transmitted to the partitioning plate 6 can be minimized, and the partitioning plate 6 or can be made thin. Particularly, the partitioning plate 6 is a relatively large member since it divides the bottom plate 2 into the indoor side 7 and the outdoor side 8, and the thickness of the partitioning plate 6 can be reduced to thereby lower its cost.

Figure 12:
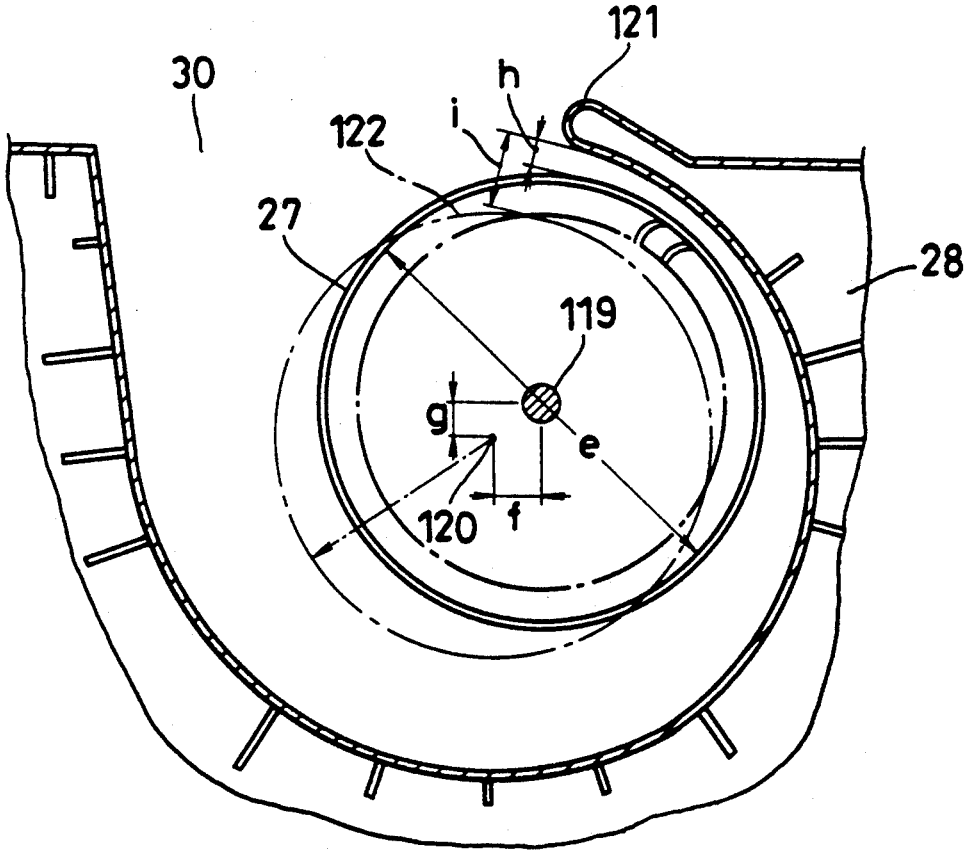
FIG. 12 is an explanatory view showing the relationship between a centrifugal fan and a fan scroll.
Figure 13:
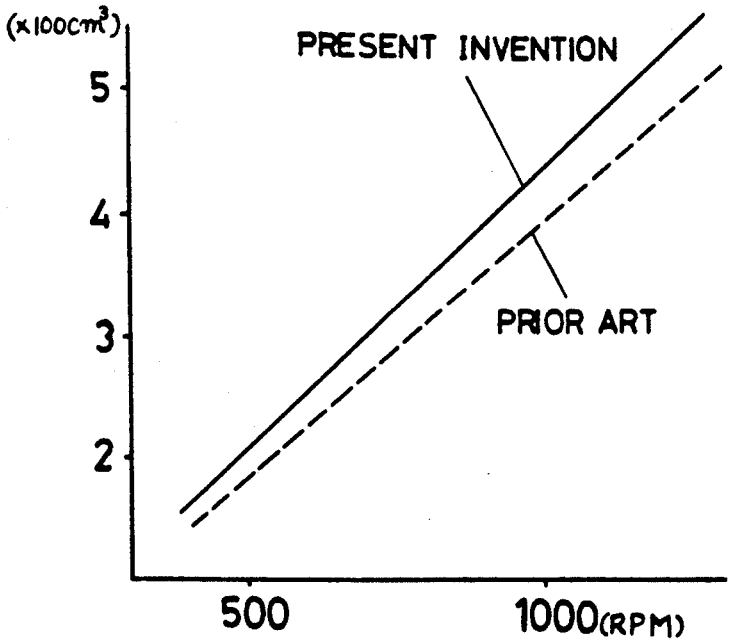
FIG. 13 is a graph showing the relationship between the number of revolutions of the prior art centrifugal fan and the quantity of air discharged of the air conditioner of the present invention.

FIG. 12 is a front view showing the relationship between the centrifugal fan 27 and the fan scroll 28 and FIG. 13 is a graph showing characteristics of the air quantity - number of revolutions, respectively. A diameter e of the centrifugal fan 27 in a preferred embodiment is 180 mm. and a center 199 thereof is offset by a dimension g (7 mm) on a dimension f (10 mm) leftward from a center 120 of the fan casing 28. Since within the fan scroll, the centrifugal fan 27 is located close to the nose portion 121 of the fan scroll 28 as described above, a dimension of a gap between the nose portion 121 and the centrifugal fan 27 resultantly is approximately 11 mm. (Note that the a dimension of a gap between the nose portion 121 and the centrifugal fan 122 when the center 120 of the fan scroll 28 is coincident with the center of the centrifugal fan 122 is approximately 20 mm.) In FIG. 13, the relationship between the number of revolutions of the centrifugal fan 27 and the air quantity in the case where the center 119 of the centrifugal fan 27 is offset form the center 119 of the fan scroll 28 (the embodiment of the present invention) is indicated by the solid line, and the relationship between the number of revolutions of the centrifugal fan 122 and the air quantity in the, case where the center 120 of the centrifugal fan 122 is coincident with the center 120 of the fan scroll 28 (the state indicated by the broken line in FIG. 12) is indicated by the broken line. According to this, in the case where the center 119 of the centrifugal fan 27 is, offset from the center 120 of the fan scroll 28 (the solid line), the air quantity of $0.25\times100$ cm$^3$ has been increased at the same number of revolutions as compared with the case where both the centers are coincident (the broken line). This probably results from the fact that in the case where the center 119 of the centrifugal fan 27 is offset from the center 120 of the fan scroll 28, the dimension h of the gap between the nose portion 121 and the centrifugal fan 27 is small whereby air blown out of the discharge opening 30 of the fan scroll 28 is difficult to suck into the gap.

Figure 14:
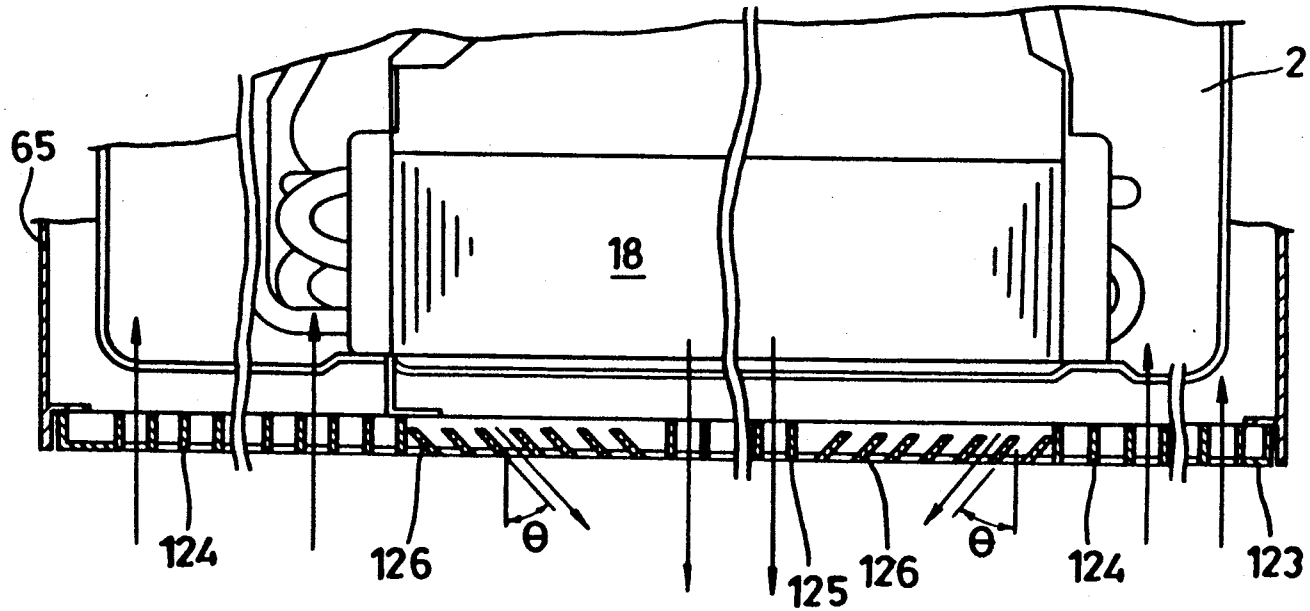
FIG. 14 is a sectional view of a rear grill of the air conditioner.

FIG. 14 is a plan view showing the relationship between a rear grill 124 and body 1 of the air conditional 66. Reference numeral 124 designates an intake frame connected to an intake vent, and 125 designates a discharge frame positioned at the rear of the outdoor heat exchanger 18. Particularly, both ends 126 near the intake frame 124 are inwardly inclined at an angle of $\phi$ ($45°\pm2°$). With this inclination, outdoor air discharged out of both ends 126 of the discharge frame 125 flows as indicated by the arrow to greatly prevent an air short whereby the discharged air is sucked into the air conditioner 66 through the intake frame 124.

Figure 15:
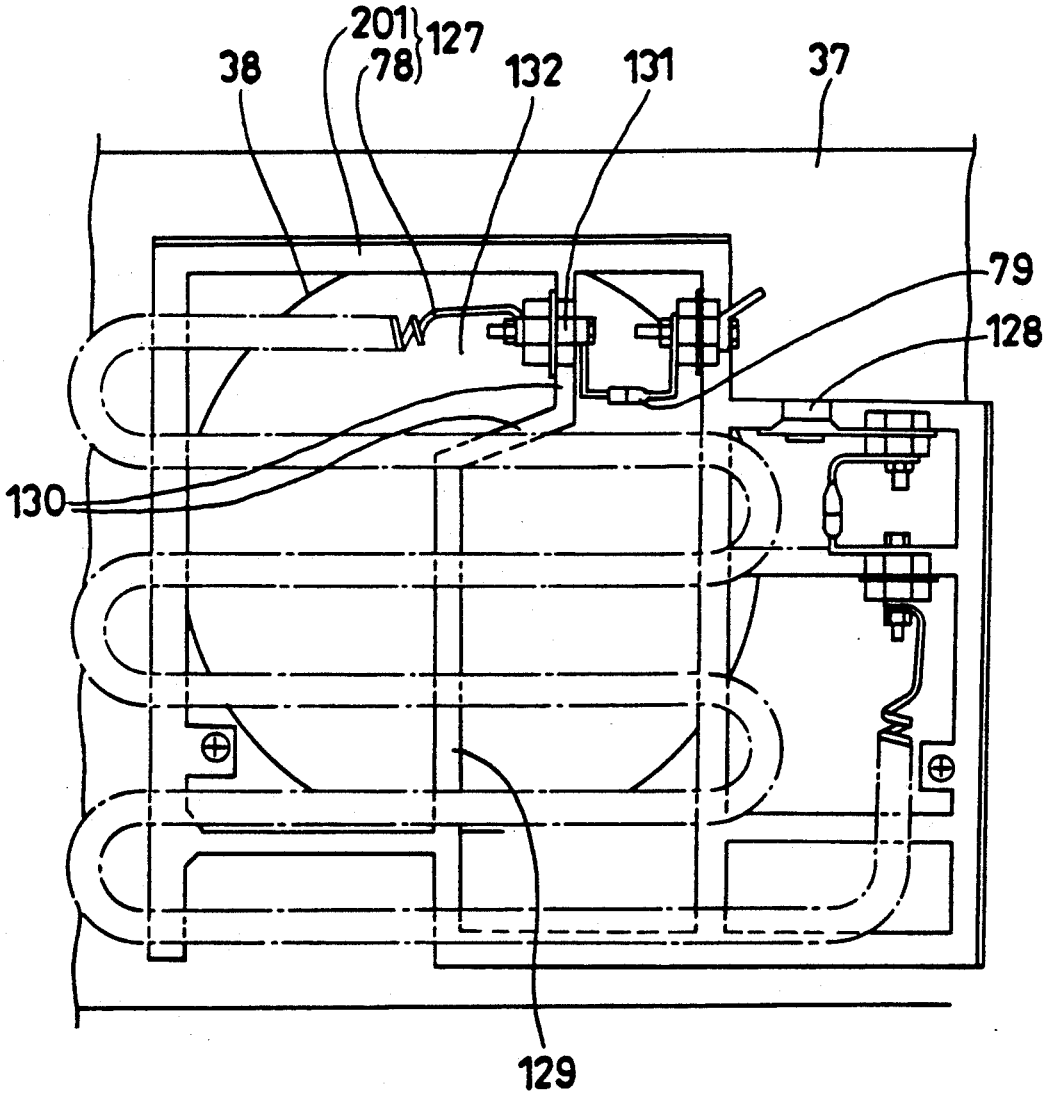
FIG. 15 is an elevational view of a heater member mounted on the air conditioner.

In FIG. 15, reference numeral 127 designates a heater member secured to the front surface of the mounting plate 37. The heater member 127 comprises a support frame 201 secured to the mounting plate 37 and a heater 78 arranged in a zig-zag fashion on the support frame 201. Reference numeral 128 designates a thermostat, which is one of protective devices of the heater 78. The heater 78 and the support frame 201 are supported at an intersection therebetween. Particularly, sag of the heater 78 is prevented by a central member 129 of the support frame 201. An upper portion 130 of the central member 129 is bent rightward (in FIG. 15), said upper portion 130 also serving as the fixing portion 132 for one end of the fuse 79 of the heater 78. In other words, since the upper portion 130 of the central member 129 provided to prevent sag of the heater 78 is bent rightward in order that the former also serves as the fixing portion for the fuse 79, the central member 129 disappears in the vicinity of the upper portion 132 in the central portion of an intake hole 38 due to the presence of the aforesaid in order to reduce a ventilation resistance in the portion 132. Thereby the intake air quantity is prevented form being lowered.

As described above, according to the present invention, if the mounting plate mounted on the intake vent of the fan scroll of the centrifugal fan is removed, the centrifugal fan can be removed from the discharge opening of the scroll without moving the scroll. Thereby, inspecting of the centrifugal fan is simply carried out. In addition, the scroll and the mounting plate are removed and the scroll itself is not divided, and therefore, even if the aforesaid inspecting is repeatedly carried out, a possible leak of air from the scroll itself can be reduced.

Furthermore, by removing the pipe cover around the discharge opening, inspecting of the heat exchanger positioned frontwardly of the blower device can be done simply.

What is claimed is:

1. An air conditioner having an interior divided into two chambers by a partitioning plate, one chamber housing therein a heat exchanger, a centrifugal type fan having a given diameter and given thickness, and a fan scroll for said fan, the other chamber having a motor arranged therein, said fan being rotatably supported on a shaft of said motor which extends through said partitioning plate such that an adjacent side of the fan is spaced a given distance from the heat exchanger, wherein the fan scroll has a scroll portion and a nose portion integral with said scroll portion, said scroll further defining a front portion having a vent opening nd an upper portion having a discharge opening, said openings merging to form a single continuous opening to said front and upper portions of said scroll, said scroll having a back portion opposite said front portion which is mounted on said partitioning plate, said vent opening and said discharge opening being larger than the diameter of said fan, the heat exchanger being spaced from the scroll a distance greater than the distance the motor shaft projects from the partitioning plate, the shaft projecting beyond said partitioning plate a distance less than the spacing between the adjacent side of the fan and the heat exchanger, a mounting plate having an intake hole mounted on the front portion of the scroll so that the intake hole registers with the vent opening, and a plate for covering a gap between the mounting plate and heat exchanger so as to bridge over an upper member of the heat exchanger and an upper portion of the mounting plate.

2. An air conditioner according to claim 1, wherein an electric heater is mounted on the surface of the mounting plate on the side of the heat exchanger.

* * * * *